US010598415B2

(12) United States Patent
Toyooka

(10) Patent No.: US 10,598,415 B2
(45) Date of Patent: Mar. 24, 2020

(54) REFRIGERATION APPARATUS WITH DRY ICE OCCURRENCE SUPPRESSION STRUCTURE

(71) Applicant: PHC HOLDINGS CORPORATION, Tokyo (JP)

(72) Inventor: Takashi Toyooka, Saitama (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 250 days.

(21) Appl. No.: 15/061,809

(22) Filed: Mar. 4, 2016

(65) Prior Publication Data

US 2016/0187038 A1 Jun. 30, 2016

Related U.S. Application Data

(63) Continuation of application No. PCT/JP2014/004850, filed on Sep. 22, 2014.

(30) Foreign Application Priority Data

Sep. 27, 2013 (JP) ..... 2013-201827

(51) Int. Cl.
*F25B 43/00* (2006.01)
*F25B 7/00* (2006.01)
(Continued)

(52) U.S. Cl.
CPC ..... *F25B 43/00* (2013.01); *F25B 7/00* (2013.01); *F25B 9/006* (2013.01); *F25B 41/067* (2013.01);
(Continued)

(58) Field of Classification Search
CPC .. F25B 7/00; F25B 9/006; F25B 9/008; F25B 2400/052; F25B 2400/054; F25B 2313/008; F25B 2341/062; F25B 41/067
See application file for complete search history.

(56) References Cited

U.S. PATENT DOCUMENTS 2,776,552 A * 1/1957 Thomas ..... F25B 41/067 138/44
4,019,337 A * 4/1977 Zearfoss, Jr. ..... F25B 1/00 62/113
(Continued)

FOREIGN PATENT DOCUMENTS

JP 2001-019944 A 1/2001
JP 2001-227822 A 8/2001
(Continued)

OTHER PUBLICATIONS

International Search Report issued in PCT/JP2014/004850, dated Jan. 6, 2015.
(Continued)

*Primary Examiner* — Nelson J Nieves
(74) *Attorney, Agent, or Firm* — McDermott Will & Emery LLP

(57) ABSTRACT

A refrigeration apparatus includes: a refrigerant circuit that condenses a refrigerant discharged from a compressor, decompresses the refrigerant with a capillary tube, and causes the refrigerant to evaporate in an evaporator to exhibit a refrigeration effect, wherein, as the refrigerant in the refrigerant circuit, a mixed refrigerant containing a first refrigerant having a boiling point in an ultralow temperature range of not less than −89.0° C. and not more than −78.1° C. and carbon dioxide (R744) is enclosed, and a heater that heats at least a portion of a suction pipe through which the refrigerant that returns from the evaporator to the compressor passes is provided.

15 Claims, 9 Drawing Sheets

(51) Int. Cl.

| | |
|---|---|
| ***F25B 9/00*** | (2006.01) |
| ***F28D 7/14*** | (2006.01) |
| ***F25B 41/06*** | (2006.01) |
| ***F25B 49/02*** | (2006.01) |
| *F25B 40/00* | (2006.01) |
| *F25B 6/04* | (2006.01) |
| *F25B 31/00* | (2006.01) |

(52) U.S. Cl.
CPC ..... *F25B 49/02* (2013.01); *F28D 7/14* (2013.01); *F25B 6/04* (2013.01); *F25B 9/008* (2013.01); *F25B 31/006* (2013.01); *F25B 40/00* (2013.01); *F25B 2400/01* (2013.01); *F25B 2400/052* (2013.01); *F25B 2400/054* (2013.01); *F25B 2400/12* (2013.01)

(56) References Cited

U.S. PATENT DOCUMENTS

| | | | | | |
|---|---|---|---|---|---|
| 4,147,037 | A * | 4/1979 | Gelbard | B23P 15/26 | 138/140 |
| 4,332,138 | A * | 6/1982 | Nakagawa | F25B 5/04 | 62/199 |
| 5,158,747 | A * | 10/1992 | Manz | G01N 33/0049 | 422/83 |
| 5,471,850 | A * | 12/1995 | Cowans | F25B 1/10 | 165/80.4 |
| 5,606,870 | A * | 3/1997 | Lester | F25B 9/00 | 62/434 |
| 6,305,188 | B1 * | 10/2001 | Park | F25B 40/00 | 62/513 |
| 6,351,950 | B1 * | 3/2002 | Duncan | F25B 25/00 | 62/279 |
| 6,848,268 | B1 * | 2/2005 | Memory | F25B 1/10 | 62/228.5 |
| 6,895,768 | B2 * | 5/2005 | Sakamoto | F25B 9/008 | 62/196.4 |
| 2005/0150248 | A1 * | 7/2005 | Manole | F25B 25/00 | 62/513 |
| 2006/0010905 | A1 * | 1/2006 | Gu | F25B 40/00 | 62/503 |
| 2006/0032268 | A1 * | 2/2006 | Cole | F25B 40/06 | 62/513 |
| 2006/0266077 | A1 * | 11/2006 | Wiest | F25B 5/04 | 62/527 |
| 2010/0181523 | A1 | 7/2010 | Kelley et al. | | |
| 2011/0126575 | A1 * | 6/2011 | Kobayashi | F25B 7/00 | 62/333 |
| 2012/0073317 | A1 * | 3/2012 | Lee | F25D 23/02 | 62/115 |
| 2012/0198868 | A1 * | 8/2012 | Huff | F25B 9/008 | 62/115 |
| 2012/0216551 | A1 | 8/2012 | Minor et al. | | |
| 2013/0219951 | A1 * | 8/2013 | Hyun | F25B 41/003 | 62/498 |
| 2015/0059371 | A1 * | 3/2015 | Wu | F25B 41/00 | 62/115 |
| 2016/0195321 | A1 * | 7/2016 | Low | C09K 3/30 | 62/77 |

FOREIGN PATENT DOCUMENTS

| | | | | |
|---|---|---|---|---|
| JP | 3244296 | B2 | 1/2002 | |
| JP | 2007155259 | A * | 6/2007 | F25B 13/00 |
| JP | 2007-178042 | A | 7/2007 | |
| JP | 2007212035 | A * | 8/2007 | F25B 13/00 |
| JP | 2009-062471 | A | 3/2009 | |
| JP | 4304832 | B2 * | 7/2009 | |
| JP | 2010-096484 | A | 4/2010 | |
| JP | 2011-112351 | A | 6/2011 | |
| WO | WO-2010032415 | A1 * | 3/2010 | F25B 13/00 |
| WO | WO-2010146803 | A1 * | 12/2010 | F25B 13/00 |

OTHER PUBLICATIONS

Extended European Search Report issued in corresponding EP Application No. 14846796.2, dated Oct. 4, 2016.

* cited by examiner

FIG.3

| REFRIGERANT | BOILING POINT | GWP |
|---|---|---|
| R508A | -85.7℃ | 13214 |
| R508B | -86.9℃ | 13396 |
| R170 | -88.8℃ | 3 |
| R1132a | -83.5 | 10 |
| R32 | -51.7℃ | 650 |
| R134a | -26.1℃ | 1300 |
| R744 | -78.4℃ | 1 |
| R600(N-PENTANE) | 36℃ | - |
| R600a | -12℃ | 5 |
| R1234yf | -29.4℃ | 4 |
| R1234ze | -19℃ | 6 |

REFRIGERATION APPARATUS WITH DRY ICE OCCURRENCE SUPPRESSION STRUCTURE

CROSS-REFERENCE TO RELATED APPLICATIONS

This application is based upon and claims the benefit of priority from the prior Japanese Patent Application No. 2013-201827, filed on Sep. 27, 2013 and International Patent Application No. PCT/JP2014/004850, filed on Sep. 22, 2014, the entire content of each of which is incorporated herein by reference.

BACKGROUND OF THE INVENTION

1. Field of the Invention

The present invention relates to refrigeration apparatuses that attain an ultralow temperature of −80° C. or the like and in particular relates to a refrigeration apparatus that uses a refrigerant composite material containing carbon dioxide (R744).

2. Description of the Related Art

Conventionally, for example, a refrigerant having a low boiling point, such as ethane (R170) having a boiling point of −88.8° C., R508A having a boiling point of −85.7° C. (azeotropic mixture of 39 mass % trifluoromethane (R23) and 61 mass % hexafluoroethane (R116)), and R508B having a boiling point of −86.9° C. (azeotropic mixture of 46 mass % trifluoromethane (R23) and 54 mass % hexafluoroethane (R116)), is used in a refrigeration apparatus capable of cooling its interior to an ultralow temperature of −80° C. or the like (e.g., refer to patent document 1).

In addition, to reduce the global-warming potential (hereinafter, referred to as GWP) and the inflammability, it is being proposed that carbon dioxide (R744, GWP=1) be mixed with the aforementioned primary refrigerant. Carbon dioxide (R744) has high thermal conductivity, and mixing carbon dioxide (R744) produces such effects as an increase in the density of the refrigerant sucked into a compressor and an increase in the circulation amount. Thus, an improvement in the refrigeration performance can be expected from such mixing with the aforementioned primary refrigerant.

In addition, in this type of refrigeration apparatus, the performance is improved by constituting a double pipe by a suction pipe through which a refrigerant that returns from a final-stage evaporator to a compressor passes and a capillary tube through which a refrigerant travels toward the evaporator, and by allowing the refrigerants to exchange heat therebetween (e.g., refer to patent document 2).

[patent document 1] Japanese Patent No. 3244296

[patent document 2] JP2011-112351

The boiling point of carbon dioxide (R744) is −78.4° C., which is high as compared to that of ethane (R170) or the like serving as a primary refrigerant, and carbon dioxide (R744) is less likely to evaporate even in a final evaporator. Thus, the refrigerant exiting from the evaporator contains a very high proportion of carbon dioxide (R744) and is at an ultralow temperature of −80° C. or the like. Meanwhile, pressure loss is likely to occur at the aforementioned double pipe portion, leading to a situation in which carbon dioxide (R744) is solidified at this portion and turns into dry ice, which clogs up a pipe in a refrigerant circuit.

Thus, there has been a problem in that this dry ice prevents the refrigerant from circulating in the refrigerant circuit, leading to a sudden rise in the temperature inside the refrigeration apparatus.

SUMMARY OF THE INVENTION

The present invention has been made to solve such existing technical problems and is directed to providing a refrigeration apparatus capable of effectively suppressing an occurrence of inconvenience caused by carbon dioxide (R744) turning into dry ice.

In order to solve the above problems, a refrigeration apparatus in one embodiment includes a refrigerant circuit that condenses a refrigerant discharged from a compressor, decompresses the refrigerant with a capillary tube, and causes the refrigerant to evaporate in an evaporator to exhibit a refrigeration effect. As the refrigerant in the refrigerant circuit, a mixed refrigerant containing a first refrigerant having a boiling point in an ultralow temperature range of not less than −89.0° C. and not more than −78.1° C. and carbon dioxide (R744) is enclosed. A heater that heats at least a portion of a suction pipe through which the refrigerant that returns from the evaporator to the compressor passes is provided.

BRIEF DESCRIPTION OF DRAWINGS

Embodiments will now be described, by way of example only, with reference to the accompanying drawings which are meant to be exemplary, not limiting, and wherein like elements are numbered alike in several Figures, in which:

FIG. 3 is a diagram for describing the properties of refrigerants used in examples;

DETAILED DESCRIPTION OF THE INVENTION

Figure 1:
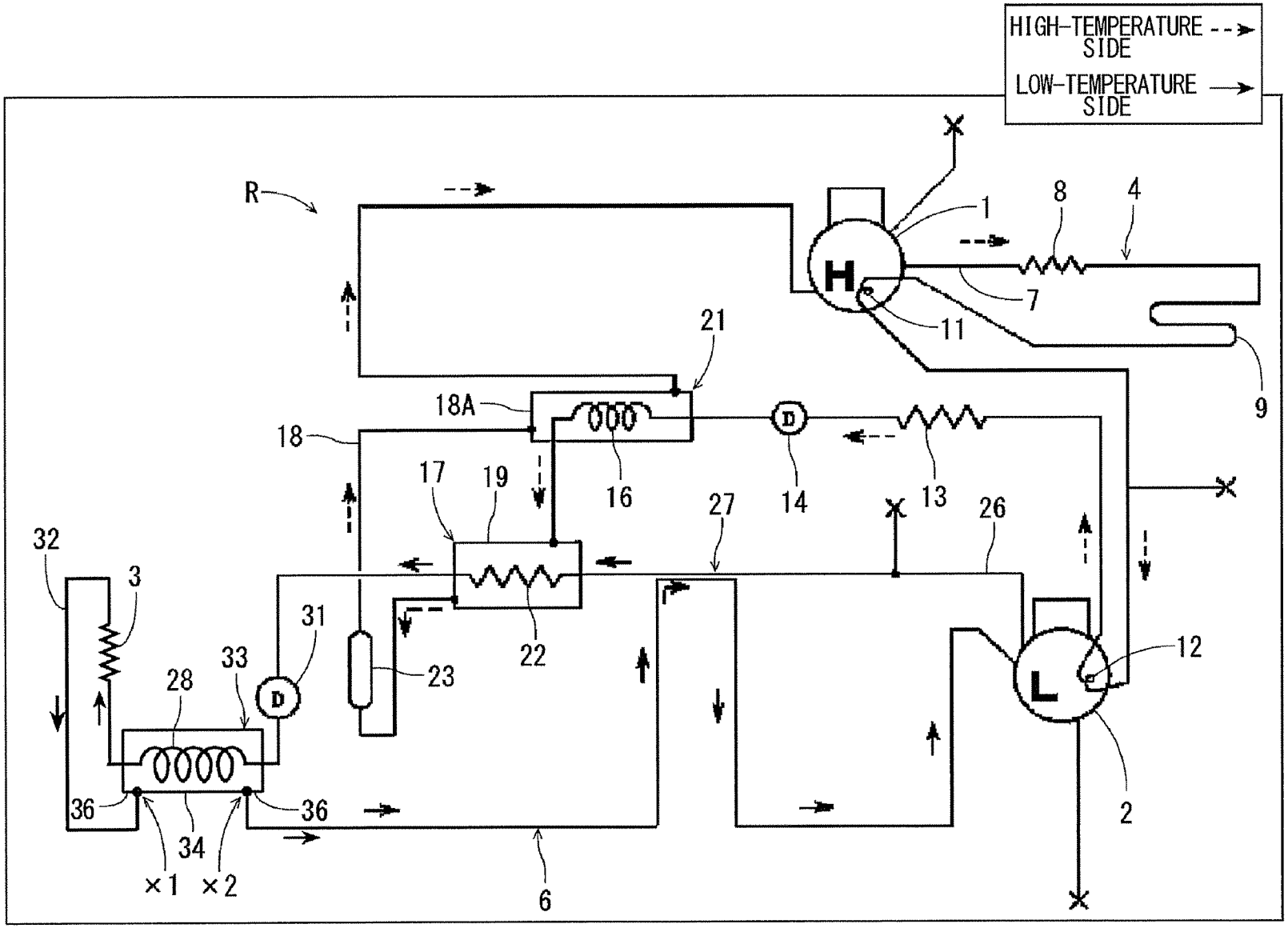
FIG. 1 is a diagram of a refrigerant circuit in a refrigeration apparatus of an example of the present invention.

In order to solve the above problems, a refrigeration apparatus of an embodiment 1 includes a refrigerant circuit that condenses a refrigerant discharged from a compressor, decompresses the refrigerant with a capillary tube, and causes the refrigerant to evaporate in an evaporator to exhibit a refrigeration effect. As the refrigerant in the refrigerant circuit, a mixed refrigerant containing a first refrigerant having a boiling point in an ultralow temperature range of not less than −89.0° C. and not more than −78.1° C. and carbon dioxide (R744) is enclosed. A heater that heats at least a portion of a suction pipe through which the refrigerant that returns from the evaporator to the compressor passes is provided.

In the refrigeration apparatus of an embodiment 2, in the above embodiment 1, a double-pipe structure is provided by constituting at least a portion of the suction pipe through which the refrigerant that returns from the evaporator to the compressor passes by a main pipe and connection pipes connected to respective ends of the main pipe, by disposing the capillary tube in the main pipe, and by pulling out the capillary tube through the connection pipes at the respective ends; and the heater heats at least a portion of the double-pipe structure.

In the refrigeration apparatus of an embodiment 3, the mixed refrigerant in each of the above embodiments further contains a second refrigerant that is soluble in carbon dioxide (R744) at a temperature lower than a boiling point of carbon dioxide (R744).

A refrigeration apparatus of an embodiment 4 includes a refrigerant circuit that condenses a refrigerant discharged from a compressor, decompresses the refrigerant with a capillary tube, and causes the refrigerant to evaporate in an evaporator to exhibit a refrigeration effect. A double-pipe structure is provided by constituting at least a portion of a suction pipe through which the refrigerant that returns from the evaporator to the compressor passes by a main pipe and connection pipes connected to respective ends of the main pipe, by disposing the capillary tube in the main pipe, and by pulling out the capillary tube through the connection pipes at the respective ends. As the refrigerant in the refrigerant circuit, a mixed refrigerant containing a first refrigerant having a boiling point in an ultralow temperature range of not less than −89.0° C. and not more than −78.1° C., carbon dioxide (R744), and a second refrigerant that is soluble in carbon dioxide (R744) at a temperature lower than a boiling point of carbon dioxide (R744) is enclosed.

In the refrigeration apparatus of an embodiment 5, in the embodiment 4, a heater that heats at least a portion of the double-pipe structure is provided.

In the refrigeration apparatus of an embodiment 6, in any one of the embodiments 2, 3, and 5, a control unit that controls passage of electricity to the heater is provided, and the control unit passes the electricity to the heater in a case in which a temperature of the double-pipe structure reaches or falls below a predetermined value.

In the refrigeration apparatus of an embodiment 7, the control unit in the embodiment 6 passes the electricity to the heater in a case in which the temperature of the double-pipe structure reaches or falls below the predetermined value and a temperature of a target to be cooled through the refrigeration effect rises with respect to a set value.

In the refrigeration apparatus of an embodiment 8, in any one of the embodiments 2, 3, and 5 through 7, a high-temperature-side refrigerant circuit and a low-temperature-side refrigerant circuit are provided, and an evaporator in the high-temperature-side refrigerant circuit and a condenser in the low-temperature-side refrigerant circuit constitute a cascade heat exchanger. The double-pipe structure is provided in the low-temperature-side refrigerant circuit; and in the low-temperature-side refrigerant circuit, the mixed refrigerant is enclosed, or the heater is provided in addition to the mixed refrigerant enclosed therein.

In the refrigeration apparatus of an embodiment 9, in any one of embodiments 2 through 8, the connection pipe has a shape that is prone to pressure loss. In the refrigeration apparatus of an embodiment 10, the connection pipe in the embodiment 9 is a T-pipe.

According to the embodiment 1, a refrigeration apparatus includes a refrigerant circuit that condenses a refrigerant discharged from a compressor, decompresses the refrigerant with a capillary tube, and causes the refrigerant to evaporate in an evaporator to exhibit a refrigeration effect. As the refrigerant in the refrigerant circuit, a mixed refrigerant containing a first refrigerant having a boiling point in an ultralow temperature range of not less than −89.0° C. and not more than −78.1° C. and carbon dioxide (R744) is enclosed, and a heater that heats at least a portion of a suction pipe is provided. In addition, or in place of providing the heater, the mixed refrigerant further contains a second refrigerant that is highly soluble in carbon dioxide (R744). Accordingly, in the refrigeration apparatus including a double-pipe structure that is constituted, as in the embodiment 2 or 4, by constituting at least a portion of the suction pipe through which the refrigerant that returns from the evaporator to the compressor passes by a main pipe and connection pipes connected to respective ends of the main pipe, by disposing the capillary tube in the main pipe, and by pulling out the capillary tube through the connection pipes at the respective ends and in which the connection pipes are constituted, as in the embodiment 9 or 10, by a T-pipe or the like that is prone to pressure loss, carbon dioxide (R744) can be prevented from turning into dry ice at the aforementioned portions, and the stable refrigeration effect can be exhibited.

In particular, a control unit that controls passage of electricity to the heater is provided, and the control unit passes the electricity to the heater in a case in which a temperature of the double-pipe structure reaches or falls below a predetermined value, as in the embodiment 6, or the control unit passes the electricity to the heater in a case in which the temperature of the double-pipe structure reaches or falls below the predetermined value and a temperature of a target to be cooled through the refrigeration effect rises with respect to a set value, as in the embodiment 7. Thus, heating of the double-pipe structure by the heater can be controlled with accuracy.

In addition, in the refrigeration apparatus in which a high-temperature-side refrigerant circuit and a low-temperature-side refrigerant circuit are provided, an evaporator in the high-temperature-side refrigerant circuit and a condenser in the low-temperature-side refrigerant circuit constitute a cascade heat exchanger, and the double-pipe structure is provided in the low-temperature-side refrigerant circuit, as in the embodiment 8; the present invention is particularly effective when the mixed refrigerant is enclosed in the low-temperature-side refrigerant circuit, or a heater is additionally provided.

Hereinafter, embodiments of the present invention will be described in detail.

Example 1

(1) Refrigeration Apparatus R

Figure 9:
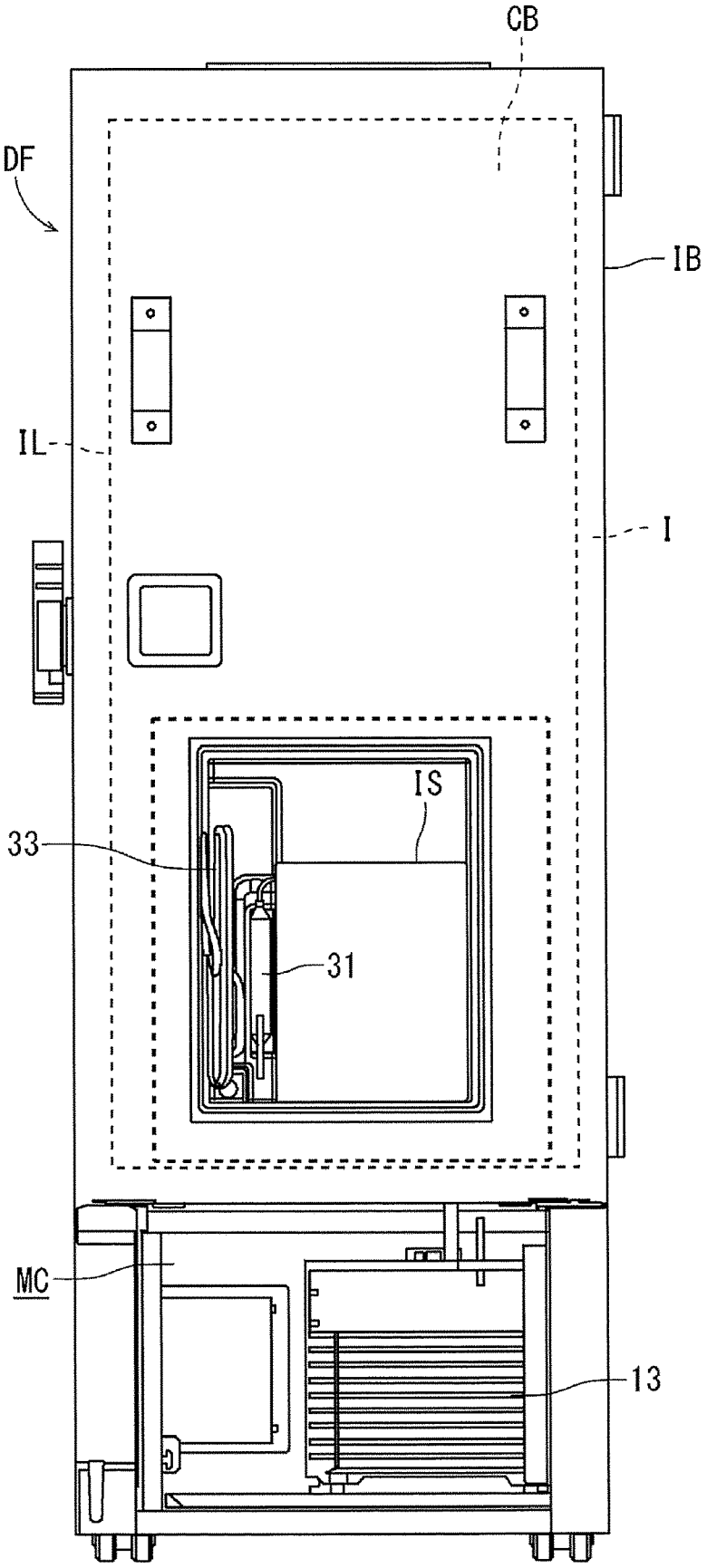
FIG. 9 is a rear view of an ultralow-temperature storage of an example to which the present invention is applied.

FIG. 1 is a diagram of a refrigerant circuit in a refrigeration apparatus R of an example that cools the interior of a storage room CB of an ultralow-temperature storage DF of an example illustrated in FIG. 9 to a temperature (inner temperature) of −80° C. or lower, e.g., an ultralow temperature of −85° C. to −86° C. Compressors 1 and 2 and so on constituting the refrigerant circuit of the refrigeration apparatus R are installed in a machine compartment MC located underneath a heat-insulating box IB of the ultralow-temperature storage DF; and an evaporator (refrigerant pipe) 3 is attached in a heat-exchangeable manner to a peripheral surface of an inner compartment IL of the heat-insulating box IB on the side of a heat insulator I.

(1-1) High-Temperature-Side Refrigerant Circuit 4

As a cascade (binary) single-stage refrigerant circuit, the refrigerant circuit of the refrigeration apparatus R of the present example is constituted by a high-temperature-side refrigerant circuit 4 and a low-temperature-side refrigerant circuit 6, which each constitute an independent refrigerant closed circuit. The compressor 1 constituting the high-temperature-side refrigerant circuit 4 is an electromotive compressor that uses a single-phase or three-phase AC power supply. A refrigerant compressed by the compressor 1 is discharged to a refrigerant discharge pipe 7 connected to the compressor 1 at its discharge side. The refrigerant discharge pipe 7 is connected to a pre-condenser 8. The pre-condenser 8 is connected to a frame pipe 9 for heating an opening edge of the aforementioned storage room CB to prevent dew condensation.

A refrigerant pipe from the frame pipe 9 is connected to an oil cooler 11 of the compressor 1, then to an oil cooler 12 of the compressor 2 constituting the low-temperature-side refrigerant circuit 6, and to a condenser 13. The refrigerant pipe from the condenser 13 is then connected to a high-temperature-side dehydrator (dry core) 14 and a capillary tube 16. The dehydrator 14 is a moisture removing unit for removing the moisture in the high-temperature-side refrigerant circuit 4. The capillary tube 16 is disposed inside a portion (18A) of a suction pipe 18 that extends from a high-temperature-side evaporator 19 of a cascade heat exchanger 17 and returns to the compressor 1.

Specifically, a double-pipe structure is constituted with the capillary tube 16 disposed inside the pipe 18A, which is a portion of the suction pipe 18 on an outlet side of the evaporator 19. Such a double-pipe structure allows a refrigerant flowing through the capillary tube 16 on the inner side of a double pipe 21 (hereinafter, referred to as a double-pipe structure) to exchange heat with a refrigerant, from the evaporator 19, flowing through the pipe 18A on the outer side.

In this manner, as the double-pipe structure 21 is constituted with the capillary tube 16 disposed inside the suction pipe 18 (pipe 18A), a refrigerant passing through the capillary tube 16 and a refrigerant passing through the suction pipe 18 (pipe 18A) exchange heat therebetween through thermal conduction along the entire peripheral wall surface of the capillary tube 16. Thus, as compared to a conventional structure in which a capillary tube is attached to the outer peripheral surface of a suction pipe, the heat exchanging performance can be increased considerably.

Furthermore, the entire outer periphery of the pipe 18A of the double-pipe structure 21 is surrounded by a heat insulator (not illustrated). Thus, the double-pipe structure 21 is less affected by heat from the outside, and the heat exchanging performance between a refrigerant inside the pipe 18A and a refrigerant inside the capillary tube 16 can be further increased. In addition, the refrigerant is made to flow such that the flow of a refrigerant in the capillary tube 16 on the inner side of the double-pipe structure 21 is countercurrent to that in the suction pipe 18 (pipe 18A) outside the capillary tube 16. Thus, the heat exchanging performance in the double-pipe structure 21 can be further improved.

The refrigerant pipe from the capillary tube 16 is connected to the high-temperature-side evaporator 19 provided so as to exchange heat with a condenser 22 in the low-temperature-side refrigerant circuit 6. The high-temperature-side evaporator 19, along with the condenser 22 in the low-temperature-side refrigerant circuit 6, constitutes the cascade heat exchanger 17. The suction pipe 18 from the high-temperature-side evaporator 19 passes successively through a high-temperature-side header 23 and the double-pipe structure 21 and is connected to the compressor 1 at its suction side.

(1-2) Refrigerant in High-Temperature-Side Refrigerant Circuit 4

Enclosed in the high-temperature-side refrigerant circuit 4 is an azeotropic mixture (R407D) of difluoromethane (R32)/pentafluoroethane (R125)/1,1,1,2-tetrafluoroethane (R134a); an azeotropic mixture (R404A) of pentafluoroethane (R125)/1,1,1-trifluoroethane (R143a)/1,1,1,2-tetrafluoroethane (R134a); as a refrigerant composite material having a GWP of 1500 or lower, a mixed refrigerant containing a fluorohydrocarbon mixed refrigerant that contains 1,1,1,2,3-pentafluoropentene (HFO-1234ze, GWP 6, boiling point −19° C.) in a refrigerant group of difluoromethane (R32), pentafluoroethane (R125), 1,1,1,2-tetrafluoroethane (R134a), and 1,1,1-trifluoroethane (R143a); or similarly as a refrigerant composite material having a GWP of 1500 or lower, a mixed refrigerant containing a fluorohydrocarbon mixed refrigerant that contains 1,1,1,2-tertafluoropentene (HFO-1234yf, GWP 4, boiling point −29.4° C.) in a refrigerant group of difluoromethane (R32), pentafluoroethane (R125), 1,1,1,2-tetrafluoroethane (R134a), and 1,1,1-trifluoroethane (R143a).

The boiling point is approximately −40° C. in the atmospheric pressure, and this mixed refrigerant is condensed by the pre-condenser 8, the frame pipe 9, and the condenser 13, is decompressed in the capillary tube 16, flows into the high-temperature-side evaporator 19 constituting the cascade heat exchanger 17, and evaporates therein. Thus, the temperature of the cascade heat exchanger 17 is brought to approximately −36° C.

(1-3) Flow of Refrigerant in High-Temperature-Side Refrigerant Circuit 4

In FIG. 1, the dashed arrows indicate the flow of the refrigerant circulating in the high-temperature-side refrigerant circuit 4. Specifically, a high-temperature gaseous refrigerant discharged from the compressor 1 is discharged from a sealed container through the refrigerant discharge pipe 7, releases heat in the pre-condenser 8 and the frame pipe 9, returns into the sealed container, and passes through the oil cooler 11. Thus, the interior of the sealed container can be cooled by the refrigerant with a reduced temperature. Then, the high-temperature gaseous refrigerant is condensed by the oil cooler 12 of the compressor 2 in the low-temperature-side refrigerant circuit 6 and the condenser 13 and releases heat to be liquefied; then, the moisture contained therein is removed by the dehydrator 14, and the refrigerant flows into the capillary tube 16 of the double-pipe structure 21.

In the capillary tube 16, the refrigerant exchanges heat with a refrigerant passing through the suction pipe 18 (pipe 18A), which is provided along the entire periphery of the capillary tube 16, through thermal conduction along the entire peripheral surface of the capillary tube 16, and the refrigerant is thus decompressed while having its temperature further reduced and then flows into the evaporator 19. In the evaporator 19, the refrigerant absorbs heat from a refrigerant flowing through the condenser 22 of the cascade heat exchanger 17 and thus evaporates. Thus, the refrigerant flowing through the condenser 22 is cooled.

The refrigerant that has evaporated in the evaporator 19 then exits from the high-temperature-side evaporator 19 through the suction pipe 18, flows into the double-pipe structure 21 through the high-temperature-side header 23, exchanges heat with a refrigerant flowing through the capillary tube 16 described above, and then returns to the compressor 1.

(1-4) Low-Temperature-Side Refrigerant Circuit 6

Meanwhile, like the compressor 1 in the high-temperature-side refrigerant circuit 4, the compressor 2 constituting the low-temperature-side refrigerant circuit 6 is an electromotive compressor that uses a single-phase or three-phase AC power supply. A refrigerant discharge pipe 26 of the compressor 2 extends to an internal heat exchanger 27. The internal heat exchanger 27 is a heat exchanger for allowing a high-pressure-side refrigerant that has been compressed by the compressor 2 and is traveling toward a capillary tube 28 to exchange heat with a low-pressure-side refrigerant that has evaporated in the evaporator 3 and is traveling back to the compressor 2.

The high-pressure-side refrigerant pipe past the internal heat exchanger 27 is connected to the condenser 22. As described above, the condenser 22, along with the high-temperature-side evaporator 19 in the high-temperature-side refrigerant circuit 4, constitutes the cascade heat exchanger 17. The refrigerant pipe extending from the condenser 22 is then connected to a low-temperature-side dehydrator (dry core) 31 and the capillary tube 28. The dehydrator 31 is a moisture removing unit for removing the moisture in the low-temperature-side refrigerant circuit 6. The capillary tube 28 is disposed in a main pipe 34 of a double-pipe structure 33, described later, that constitutes a part of a suction pipe 32 extending from the evaporator 3 and returning to the compressor 2.

(1-5) Structure of Double-Pipe Structure 33

Figure 2:
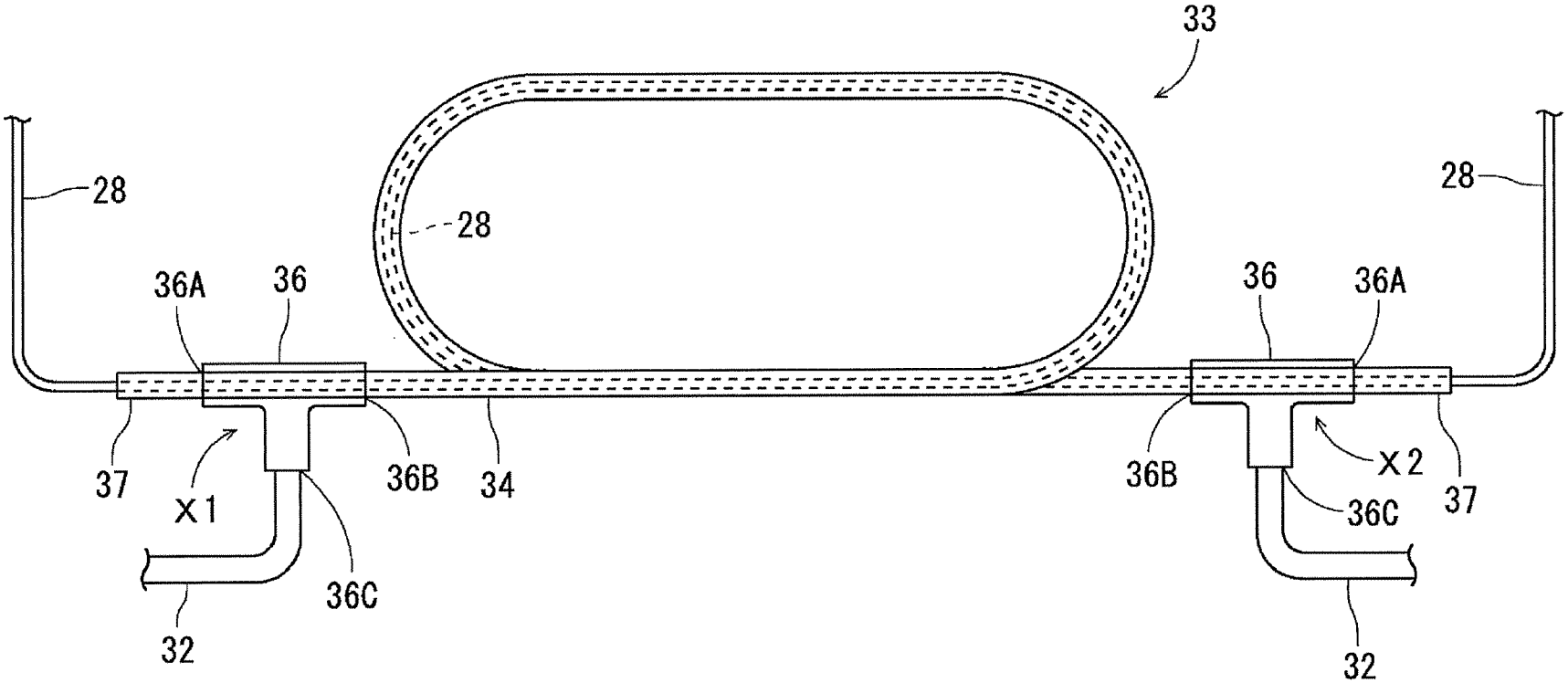
FIG. 2 is an external view of a double-pipe structure portion of the refrigeration apparatus of FIG. 1.

A specific structure is illustrated in FIG. 2. Specifically, the double-pipe structure 33 is constituted as illustrated in FIG. 2 with the capillary tube 28 disposed in the main pipe 34, which is a part (immediately past the evaporator 3) of the suction pipe 32 located on the outlet side of the evaporator 3 and upstream from the internal heat exchanger 27. Such double-pipe structure allows a refrigerant flowing through the capillary tube 28 on the inner side of the double-pipe structure 33 to exchange heat with a refrigerant, from the evaporator 3, flowing through the main pipe 34 on the outer side.

Subsequently, an example of procedures for manufacturing the double-pipe structure 33 will be described (the double-pipe structure 21 described above is also manufactured through similar procedures). First, the linear capillary tube 28 is inserted into the linear main pipe 34 having a diameter larger than that of the capillary tube 28, and a double pipe is thus provided. Then, this double pipe is wound spirally in a plurality of turns. At this point, the double pipe is wound such that the center of the axis of the main pipe 34 substantially coincides with the center of the axis of the capillary tube 28, and the spiral double pipe is formed. Thus, a substantially constant and uniform gap is formed between the inner wall surface of the main pipe 34 and the outer wall surface of the capillary tube 28. In this manner, the double pipe is wound spirally in a plurality of turns, and the spiral double-pipe structure is formed. Thus, the size can be reduced while the length of the capillary tube 28 is secured to a sufficient level and the heat exchanging portion of the double-pipe structure 33 is secured to a sufficient level.

Subsequently, a connection pipe 36, which is a T-pipe in the example, formed with one end of an end pipe 37 welded to one side end 36A is attached to each end of the main pipe 34 with the other side end 36B welded thereto, and each end of the capillary tube 28 is pulled out through a corresponding opening at the other end of each end pipe 37 of the connection pipe 36. Then, the other ends of the end pipes 37 are welded and sealed. Furthermore, the suction pipe 32 connected to the evaporator 3 at its outlet side is connected to a lower end 36C of the T-pipe of one of the connection pipes 36, and this connecting portion is welded. In a similar manner, the suction pipe 32 extending to the internal heat exchanger 27 is connected to a lower end 36C of the T-pipe of the connection pipe 36 attached to the other end of the main pipe 34, and this connecting portion is welded. Then, the outer periphery of this double-pipe structure 33 is surrounded by a heat insulator (not illustrated).

In this manner, the capillary tube 28 is inserted into the suction pipe 32 (main pipe 34 and connection pipe 36) so as to form the double-pipe structure 33; thus, a refrigerant passing through the capillary tube 28 exchanges heat with a refrigerant passing through the suction pipe 32 (main pipe 34) through thermal conduction along the entire wall surface of the capillary tube 28. Thus, as compared to a structure in which a capillary tube is attached to the outer peripheral surface of a suction pipe, the heat exchanging performance can be increased considerably.

Furthermore, as the entire outer periphery of the double-pipe structure 33 is surrounded by the heat insulator, the double-pipe structure 33 is less affected by heat from the outside, and the heat exchanging performance between a refrigerant inside the main pipe 34 and a refrigerant inside the capillary tube 28 can be further increased. In addition, the refrigerant is made to flow such that the flow of a refrigerant in the capillary tube 28 on the inner side of the double-pipe structure 33 is countercurrent to that in the suction pipe 32 (main pipe 34) outside the capillary tube 28. Thus, the heat exchanging performance in the double-pipe structure 33 can be further improved.

This double-pipe structure 33 is housed inside the heat insulator I on the back side of the inner compartment IL of the ultralow-temperature storage DF, as illustrated in FIG. 9. In FIG. 9, the heat insulator that surrounds the double-pipe structure 33 is not illustrated. In addition, IS indicated in FIG. 9 denotes a heat-insulating structure formed by surrounding the cascade heat exchanger 17 described above and so on with a heat insulator, and the heat-insulating structure is housed inside the heat insulator I on the back side of the inner compartment IL so as to be adjacent to the double-pipe structure 33. Meanwhile, the suction pipe 32 extending from the double-pipe structure 33 passes through the internal heat exchanger 27 and is connected to the compressor 2 at its suction side.

(1-6) Refrigerant Composite Material in Low-Temperature-Side Refrigerant Circuit 6

In the example, a mixed refrigerant containing ethane (R170) serving as a first refrigerant (primary refrigerant), carbon dioxide (R744) serving as a refrigerant to be mixed with the first refrigerant, and difluoromethane (R32) is enclosed in the low-temperature-side refrigerant circuit 6. The boiling points and the GWPs of the respective refrigerants are indicated in FIG. 3. Ethane (R170) has a boiling point of −88.8° C. and a GWP of 3; carbon dioxide (R744) has a boiling point of −78.4° C. and a GWP of 1; difluoromethane (R32) has a boiling point of −51.7° C. and a GWP of 650; and a refrigerant composite material containing the above has a boiling point of −86° C. or lower, with an improvement in the refrigeration performance due to carbon dioxide (R744) contributing thereto.

Since carbon dioxide (R744) has a boiling point of −78.4° C., carbon dioxide (R744) does not directly contribute to the cooling effect in the evaporator 3 that has a target evaporation temperature of −85° C. to −86° C. However, since carbon dioxide (R744) has a GWP of 1, mixing carbon dioxide (R744) makes it possible to reduce the GWP of the refrigerant enclosed in the low-temperature-side refrigerant circuit 6. As the thermal conductivity increases, the refrigeration performance can be increased, and the density of the refrigerant sucked into the compressor 2 also increases. In addition, an azeotropic effect with ethane (R170) serving as the first refrigerant can also be expected, and thus the refrigeration performance can be further improved. When the first refrigerant is inflammable, the effect of turning the refrigerant noninflammable can also be expected. In addition, difluoromethane (R32) is a refrigerant (second refrigerant) that is highly soluble in carbon dioxide (R744) at a temperature lower than the boiling point of carbon dioxide (R744).

(1-7) Flow of Refrigerant in Low-Temperature-Side Refrigerant Circuit 6

In FIG. 1, the solid arrows indicate the flow of the refrigerant circulating in the low-temperature-side refrigerant circuit 6. In describing the flow of the refrigerant in the low-temperature-side refrigerant circuit 6 specifically, a high-temperature gaseous refrigerant discharged from the compressor 2 is discharged from a sealed container through the refrigerant discharge pipe 26, is condensed by the internal heat exchanger 27 and the condenser 22, and releases heat to be liquefied; then, the moisture contained therein is removed by the low-temperature-side dehydrator 31, and the refrigerant flows into the capillary tube 28.

In the capillary tube 28, the refrigerant exchanges heat with a refrigerant passing through the suction pipe 32 (main pipe 34), which is provided along the entire periphery of the capillary tube 28, through thermal conduction along the entire peripheral surface of the capillary tube 28, and the refrigerant is thus decompressed while having its temperature further reduced and then flows into the evaporator 3. Then, ethane (R170) serving as the first refrigerant draws heat from its surrounding in the evaporator 3 and evaporates. At this point, as ethane (R170) serving as the first refrigerant evaporates in the evaporator 3, ethane (R170) exhibits the cooling effect and cools the surrounding of the evaporator 3 to an ultralow temperature of −88° C. to −90° C. As described above, the evaporator (refrigerant pipe) 3 is constituted by being wound in a heat-exchangeable manner along the heat insulator I of the inner compartment IL of the heat-insulating box IB; thus, as the evaporator 3 is cooled, the interior of the storage room CB of the ultralow-temperature storage DF can be brought to an inner temperature of −80° C. or lower. The refrigerant that has evaporated in the evaporator 3 then exits from the evaporator 3 through the suction pipe 32, passes through the above-described double-pipe structure 33 and the internal heat exchanger 27, and returns to the compressor 2.

In this manner, as the double-pipe structure 33 is constituted with the capillary tube 28 disposed in the suction pipe 32 (main pipe 34) through which the refrigerant that returns from the evaporator 3 to the compressor 2 passes, the heat exchanging efficiency between a refrigerant in the main pipe 34 and a refrigerant in the capillary tube 28 can be increased, and the performance can thus be improved. In particular, as the double-pipe structure 33 is constituted with the capillary tube 28 disposed in the main pipe 34 of the suction pipe 32 immediately past the evaporator 3, providing a configuration in which heat can be exchanged through thermal conduction along the entire peripheral wall surface of the capillary tube 28, ethane (R170) having the lowest boiling point can be cooled efficiently by the refrigerant returning from the evaporator 3, and the performance can be increased considerably. Accordingly, this is particularly effective in the ultralow-temperature storage DF as in the present example.

Furthermore, as the capillary tube 28 is disposed in the double-pipe structure 33, which is then surrounded by a heat insulator, the heat exchanging efficiency can be further improved. In addition, as the flow of a refrigerant in the capillary tube 28 is countercurrent to the flow of a refrigerant passing through the main pipe 34 outside the capillary tube 28, the heat exchanging performance can be further improved.

In addition, in the example, like the capillary tube 28 in the low-temperature-side refrigerant circuit 6, the capillary tube 16 serving as a decompressing unit in the high-temperature-side refrigerant circuit 4 is formed into the double-pipe structure 21, and this double-pipe structure 21 is surrounded by a heat insulator. Furthermore, the flow of a refrigerant in the capillary tube 16 on the inner side of the double-pipe structure 21 is countercurrent to the flow of a refrigerant in the suction pipe 18 (pipe 18A) outside the capillary tube 16. Thus, the refrigerant in the capillary tube 16 can be cooled efficiently by the refrigerant returning from the evaporator 19. Thus, the heat exchanging efficiency can be further increased, and the performance can be further improved. Generally, the refrigeration apparatus R capable of efficiently cooling the interior (interior of the storage room CB) of the ultralow-temperature storage DF to a desired ultralow temperature can be implemented.

(2) Refrigerant Composition for Preventing Carbon Dioxide from Turning into Dry Ice in Low-Temperature-Side Refrigerant Circuit 6

In the double-pipe structure 33 in the low-temperature-side refrigerant circuit 6 described above, the flow direction of the refrigerant is turned at substantially right angle at each connection pipe 36 constituted by a T-pipe along its shape (indicated by X1 and X2 in FIGS. 1 and 2). Therefore, when the refrigerant passes through the connection pipes 36, pressure loss is likely to occur.

Meanwhile, as described above, carbon dioxide (R744) has a boiling point of −78.4° C., which is high as compared to that of ethane (R170) serving as the first refrigerant, and thus carbon dioxide (744) enters the suction pipe 32 in the form of liquid or moist steam without having evaporated in the final evaporator 3. Therefore, the refrigerant that has exited from the evaporator 3 contains a very high proportion of carbon dioxide (R744) and has an ultralow temperature of −85° C. or lower; thus, carbon dioxide can turn into dry ice due to its properties.

If the refrigerant in such a condition reaches the double-pipe structure 33 in the low-temperature-side refrigerant circuit 6 and carbon dioxide (R744) is solidified and turns into dry ice at the portions X1 and X2 at which pressure loss is likely to occur as described above, the connection pipes 36 are clogged at X1 and X2, leading to a situation in which the refrigerant is prevented from circulating.

(2-1) Ethane (R170)+Carbon Dioxide (R744)

Figure 4:
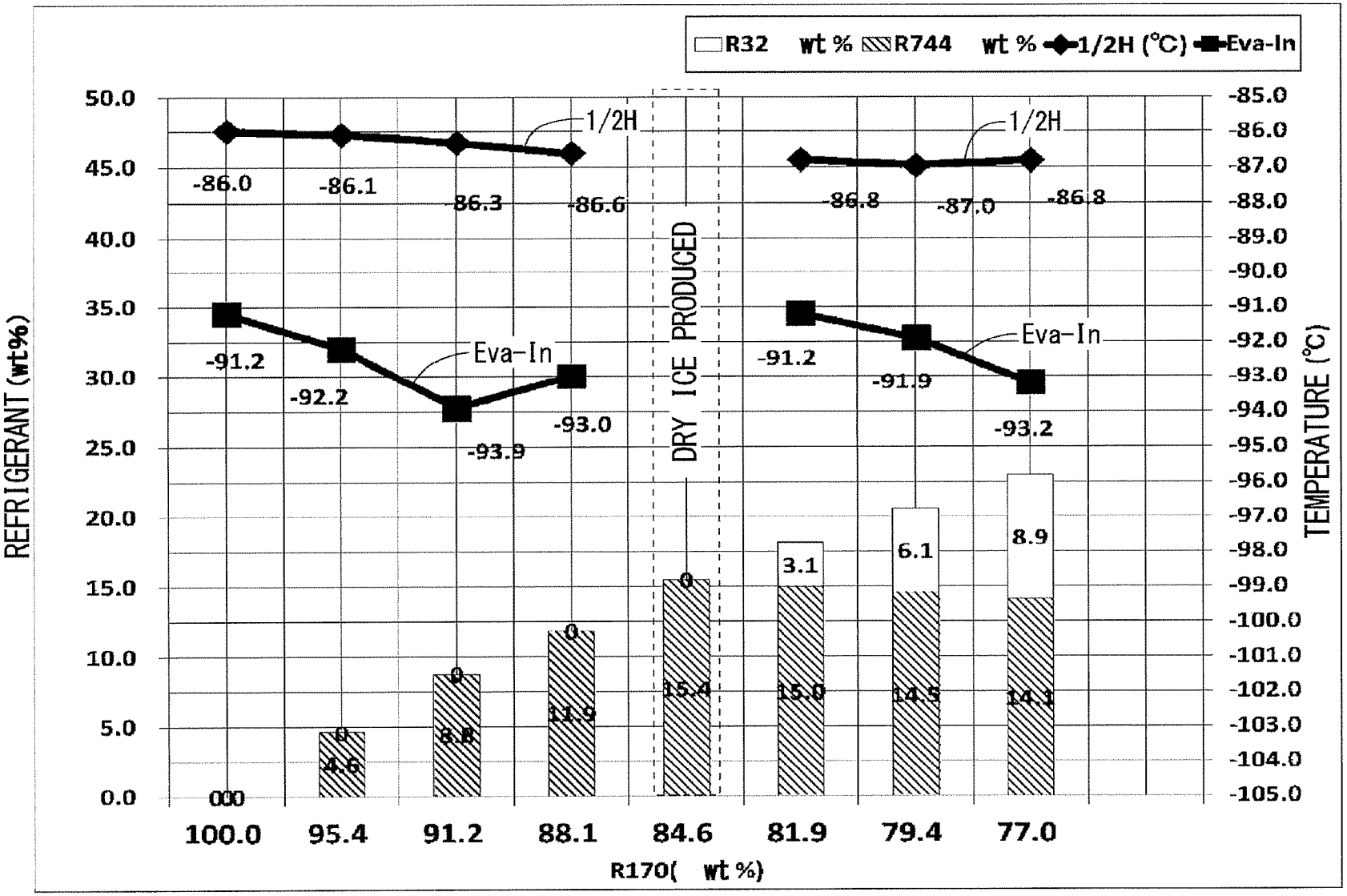
FIG. 4 is a diagram illustrating changes in the inner temperature and the evaporator-inlet temperature in a low-temperature-side refrigerant circuit of FIG. 1 with respect to each refrigerant composition in a refrigerant composite material containing ethane (R170), carbon dioxide (R744), and difluoromethane (R32)

FIG. 4 illustrates changes in the inner temperature (temperature at the middle of the interior in the height-wise direction) ½H and in the temperature at the inlet of the evaporator 3 (evaporator-inlet temperature) Eva-In when the proportion (wt %) of carbon dioxide (R744) to the total weight of the refrigerant composite material enclosed in the low-temperature-side refrigerant circuit 6 was varied stepwise (external temperature +30° C.). When ethane (R170) was at 100 (wt %), the evaporator-inlet temperature Eva-In was −91.2° C., and the inner temperature ½H was −86.0° C. When carbon dioxide (R744) was mixed therewith at 4.6 (wt %), the evaporator-inlet temperature Eva-In dropped to −92.2° C., and the inner temperature ½H dropped to −86.1° C. When the proportion of carbon dioxide (R744) to be mixed was increased to 8.8 (wt %), the evaporator-inlet temperature Eva-In dropped to −93.9° C., and the inner temperature ½H dropped to −86.3° C.

Furthermore, when the proportion of carbon dioxide (R744) to be mixed was increased to 11.9 (wt %), although the evaporator-inlet temperature Eva-In rose to −93.0° C., the inner temperature ½H dropped to −86.6° C. However, since the evaporator-inlet temperature Eva-In started to rise, it is considered that dry ice has started to be produced at the portions X1 and X2 at which pressure loss is likely to occur in the respective connection pipes 36.

Then, when the proportion of carbon dioxide (R744) to be mixed was increased up to 15.4 (wt %), the evaporator-inlet temperature Eva-In and the inner temperature ½H became extremely unstable and became unmeasurable. This indicates that carbon dioxide (R744) has turned into dry ice, which then has clogged the portions X1 and X2, preventing the refrigerant from flowing therethrough or considerably obstructing the flow. In this state, the inner temperature also rises suddenly.

(2-2) Addition of Difluoromethane (R32)

Subsequently, when difluoromethane (R32) was mixed at 3.1 (wt %) with the above composition, or the composition containing 84.6 (wt %) ethane (R170) and 15.4 (wt %) carbon dioxide (R744), each temperature stabilized; thus, the evaporator-inlet temperature Eva-In became −91.2° C., and the inner temperature ½H became −86.8° C. This indicates that difluoromethane (R32), which is highly soluble in carbon dioxide (R744), has melted and removed the dry ice that has clogged the connection pipes 36 at the portions X1 and X2. The composition at this time was 81.9 (wt %) ethane (R170), 15.0 (wt %) carbon dioxide (R744), and 3.1 (wt %) difluoromethane (R32). The reason why the proportions of ethane (R170) and of carbon dioxide (R744) to the total weight were reduced was that difluoromethane (R32) was added.

Thereafter, when the proportion of difluoromethane (R32) was increased to 6.1 (wt %), the evaporator-inlet temperature Eva-In dropped to −91.9° C., and the inner temperature ½H also dropped to −87.0° C. Furthermore, when the proportion of difluoromethane (R32) was increased to 8.9 (wt %), the evaporator-inlet temperature Eva-In became −93.2° C., and the inner temperature ½H became −86.8° C., which reveals that the temperatures have stabilized.

Figure 5:
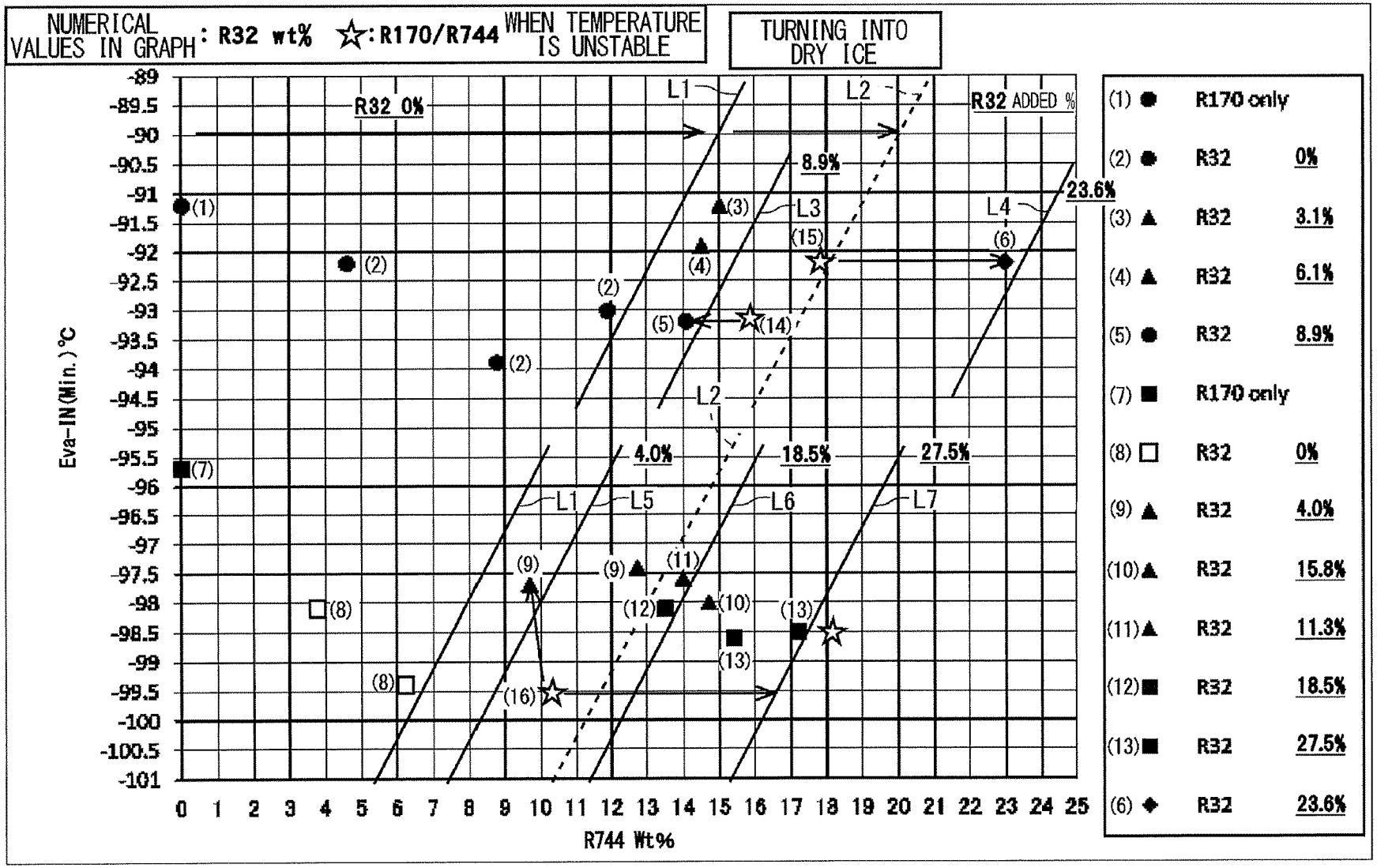
FIG. 5 is a diagram for describing production of dry ice from carbon dioxide (R744) in the refrigerant composite material of FIG. 4 and an effect of difluoromethane (R32) preventing such production.

FIG. 5 summarizes the state of carbon dioxide (R744) turning into dry ice and prevention thereof with respect to the proportions of ethane (R170), carbon dioxide (R744), and difluoromethane (R32) contained in the refrigerant composite material. In FIG. 5, the horizontal axis represents the proportion (wt %) of carbon dioxide (R744) to the total weight, and the vertical axis represents the evaporator-inlet temperature Eva-In. Two experimental results obtained with the external temperature and/or the condition of the capillary tube varied are plotted in the upper part and the lower part of FIG. 5. Under the conditions indicated by star plots (14), (15), and (16) in the figure, when a mixed refrigerant of ethane (R170) and carbon dioxide (R744) containing no difluoromethane (R32) was used, production of dry ice was experimentally confirmed.

In addition, in FIG. 5, plots (1) to (6) indicate respective cases in which ethane (R170) only, 0 (wt %), 3.1 (wt %), 6.1 (wt %), 8.9 (wt %), and 23.6 (wt %) difluoromethane (R32) in ethane (R170) and carbon dioxide (R744) are added to the refrigeration apparatus R of the example; whereas (7) to (13) indicate respective cases in which ethane (R170) only, 0 (wt %), 4.0 (wt %), 15.8 (wt %), 11.3 (wt %), 18.5 (wt %), and 27.5 (wt %) difluoromethane (R32) in ethane (R170) and carbon dioxide (R744) are added to the refrigeration apparatus R, with the condition varied as described above.

The solid line L1 in FIG. 5 indicates the boundary up to which dry ice is not produced when carbon dioxide (R744) is mixed with ethane (R170), and indicates, for example, that when the evaporator-inlet temperature Eva-In is −91° C., dry ice is not produced even if carbon dioxide (R744) is mixed at up to 14 (wt %). The range between the solid line L1 and the dashed line L2 indicates the region in which dry ice is produced, and means that when the evaporator-inlet temperature Eva-In is −91° C., dry ice is produced if, for example, carbon dioxide (R744) is added at up to 19 wt %.

In addition, the solid line L3 indicates a case in which difluoromethane (R32) was added at 8.9 (wt %) to prevent dry ice from being produced and the inner temperature ½H and the evaporator-inlet temperature Eva-In stabilized. As difluoromethane (R32) is added, the proportion of carbon dioxide (R744) is reduced to approximately 16.4 (wt %) when the evaporator-inlet temperature Eva-In is −91° C.

The case in which difluoromethane (R32) was added at 3.1 (wt %) in FIG. 4 corresponds to the plot (3) in FIG. 5; the case of 6.1 (wt %) corresponds to the plot (4) in FIG. 5; and the case of 8.9 (wt %) corresponds to the plot (5) in FIG. 5. The star plot (14), occurring when difluoromethane (R32) was not added, moved to the plot (5), approaching the solid line L3, which indicates that dry ice was prevented from being produced.

The solid line L4 in FIG. 5 indicates a case in which difluoromethane was added at up to 23.6 (wt %) to prevent dry ice from being produced and the inner temperature ½H and the evaporator-inlet temperature Eva-In stabilized. In this case, when the evaporator-inlet temperature Eva-In is, for example, −90.5° C., carbon dioxide (R744) can be mixed at up to 25 (wt %), which is greater than 20 (wt %) (dry ice is not produced). In other words, the star plot (15), occurring when difluoromethane (R32) was not added, moved to the plot (6), approaching the solid line L4, which indicates that dry ice was prevented from being produced.

For reference, as another experimental result, the solid line L5 in the lower part indicates a case in which difluoromethane (R32) was added at up to 4.0 (wt %) to prevent dry ice from being produced and the inner temperature ½H and the evaporator-inlet temperature Eva-In stabilized; and L6 and L7 indicate cases in which the proportions were increased to 18.5 (wt %) and 27.5 (wt %), respectively, to prevent dry ice from being produced and the inner temperature ½H and the evaporator-inlet temperature Eva-In stabilized.

In other words, the star plot (16), occurring when difluoromethane (R32) was not added, moved to the plot (9), approaching the solid line (5), when difluoromethane (R32)

was added at 4.0 (wt %), which indicates that dry ice was prevented from being produced.

In this manner, in the example, ethane (R170) serves as the first refrigerant, and a refrigerant composition containing ethane (R170), carbon dioxide (R744), and difluoromethane (R32) that is highly soluble in carbon dioxide (R744) is employed. Thus, as difluoromethane (R32) is added in a proportion at which carbon dioxide (R744) can be prevented from turning into dry ice as described above, even if carbon dioxide (R744) is added, for example, in a proportion greater than 20% to the total mass, dry ice can be prevented from being produced at the portions X1 and X2 at which pressure loss is likely to occur in the double-pipe structure 33 in the low-temperature-side refrigerant circuit 6, and stable refrigeration performance can be exhibited.

Example 2

(3) Ethane (R170)+carbon dioxide (R744)+1,1,1,2-tetrafluoroethane (R134a)

Subsequently, a case in which dry ice is prevented from being produced by mixing, in addition to ethane (R170) and carbon dioxide (R744), 1,1,1,2-tetrafluoroethane (R134a) in the low-temperature-side refrigerant circuit 6 will be described. Although difluoromethane (R32) is used as the refrigerant (second refrigerant) that is highly soluble in carbon dioxide (R744) in the above-described example, 1,1,1,2-tetrafluoroethane (R134a) in the present example is also the refrigerant (second refrigerant) that is highly soluble in carbon dioxide (R744) at a temperature lower than the boiling point of carbon dioxide (R744). 1,1,1,2-tetrafluoroethane (R134a) has a boiling point of −26.1° C. and a GWP of 1300. In addition, 1,1,1,2-tetrafluoroethane (R134a) is noninflammable, and the effect of turning the mixed refrigerant noninflammable can also be expected.

As in the case of FIG. 4 described above, FIG. 6 illustrates changes in the inner temperature ½H and in the evaporator-inlet temperature Eva-In when the proportion (wt %) of carbon dioxide (R744) to the total weight of the refrigerant composite material enclosed in the low-temperature-side refrigerant circuit 6 is varied (similarly, external temperature +30° C.). In this experiment, when ethane (R170) was at 100 (wt %), the evaporator-inlet temperature Eva-In was −91.8° C., and the inner temperature ½H was −86.0° C. When carbon dioxide (R744) was mixed therewith at 4.6 (wt %), the evaporator-inlet temperature Eva-In dropped to −93.1° C., and the inner temperature ½H dropped to −86.3° C. When the proportion of carbon dioxide (R744) to be mixed was increased to 10.3 (wt %), the evaporator-inlet temperature Eva-In dropped to −94.0° C., and the inner temperature ½H dropped to −86.8° C.

When the proportion of carbon dioxide (R744) to be mixed was increased up to 14.8 (wt %), the evaporator-inlet temperature Eva-In and the inner temperature ½H became extremely unstable and became unmeasurable. This indicates that carbon dioxide (R744) has turned into dry ice, which then has clogged the connection pipes 36 at the portions X1 and X2, preventing the refrigerant from flowing therethrough or considerably obstructing the flow.

(3-1) Addition of 1,1,1,2-tetrafluoroethane (R134a)

Subsequently, when 1,1,1,2-tetrafluoroethane (R134a) was mixed at 4.6 (wt %) with the above composition, or the composition of 85.2 (wt %) ethane (R170) and 14.8 (wt %) carbon dioxide (R744), each temperature stabilized; thus, the evaporator-inlet temperature Eva-In became −92.9° C., and the inner temperature ½H became −86.5° C. This indicates that 1,1,1,2-tetrafluoroethane (R134a) that is highly soluble in carbon dioxide (R744) has melted and removed the dry ice that has clogged the connection pipes 36 at the portions X1 and X2. The composition at this time was 81.3 (wt %) ethane (R170), 14.1 (wt %) carbon dioxide (R744), and 4.6 (wt %) 1,1,1,2-tetrafluoroethane (R134a). The reason why the proportions of ethane (R170) and of carbon dioxide (R744) to the total weight were reduced was that 1,1,1,2-tetrafluoroethane (R134a) was added at 4.6 (wt %).

Thereafter, when the proportion of 1,1,1,2-tetrafluoroethane (R134a) was increased to 8.3 (wt %), the evaporator-inlet temperature Eva-In dropped to −93.0° C., and the inner temperature ½H also dropped to −86.4° C. Furthermore, when the proportion of 1,1,1,2-tetrafluoroethane (R134a) was increased to 11.5 (wt %), the evaporator-inlet temperature Eva-In became −93.3° C., and the inner temperature ½H became −86.4° C., which reveals that the temperatures have stabilized.

In this manner, even when 1,1,1,2-tetrafluoroethane (R134a) is added in place of difluoromethane (R32), carbon dioxide (R744) can very effectively be prevented from turning into dry ice.

Example 3

(4) Difluoroethylene (R1132a)+carbon dioxide (R744)+difluoromethane (R32)

Subsequently, a case in which, in place of ethane (170), difluoroethylene (R1132a) serving as the first refrigerant is enclosed in the low-temperature-side refrigerant circuit 6 will be described. The refrigerant composite material in this case contains difluoroethylene (R1132a), carbon dioxide (R744), and difluoromethane (R32), and this is the case in which carbon dioxide is prevented from turning into dry ice through this composition. Difluoroethylene (R1132a) has a boiling point of −83.5° C. and a GWP of 10.

Figure 6:
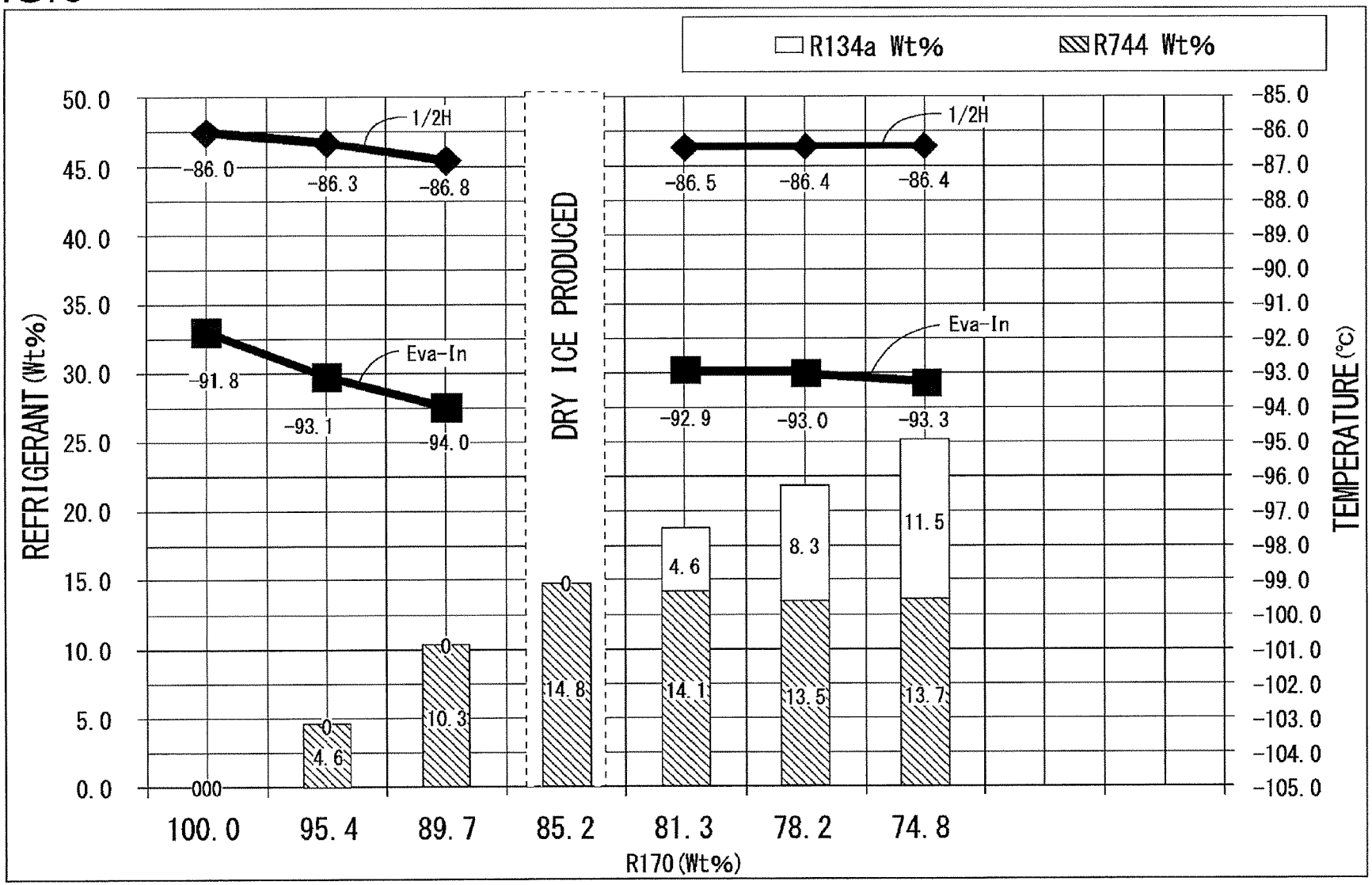
FIG. 6 is a diagram illustrating changes in the inner temperature and the evaporator-inlet temperature in the low-temperature-side refrigerant circuit of FIG. 1 with respect to each refrigerant composition in a refrigerant composite material containing ethane (R170), carbon dioxide (R744), and 1,1,1,2-tetrafluoroethane (R134a)
Figure 7:
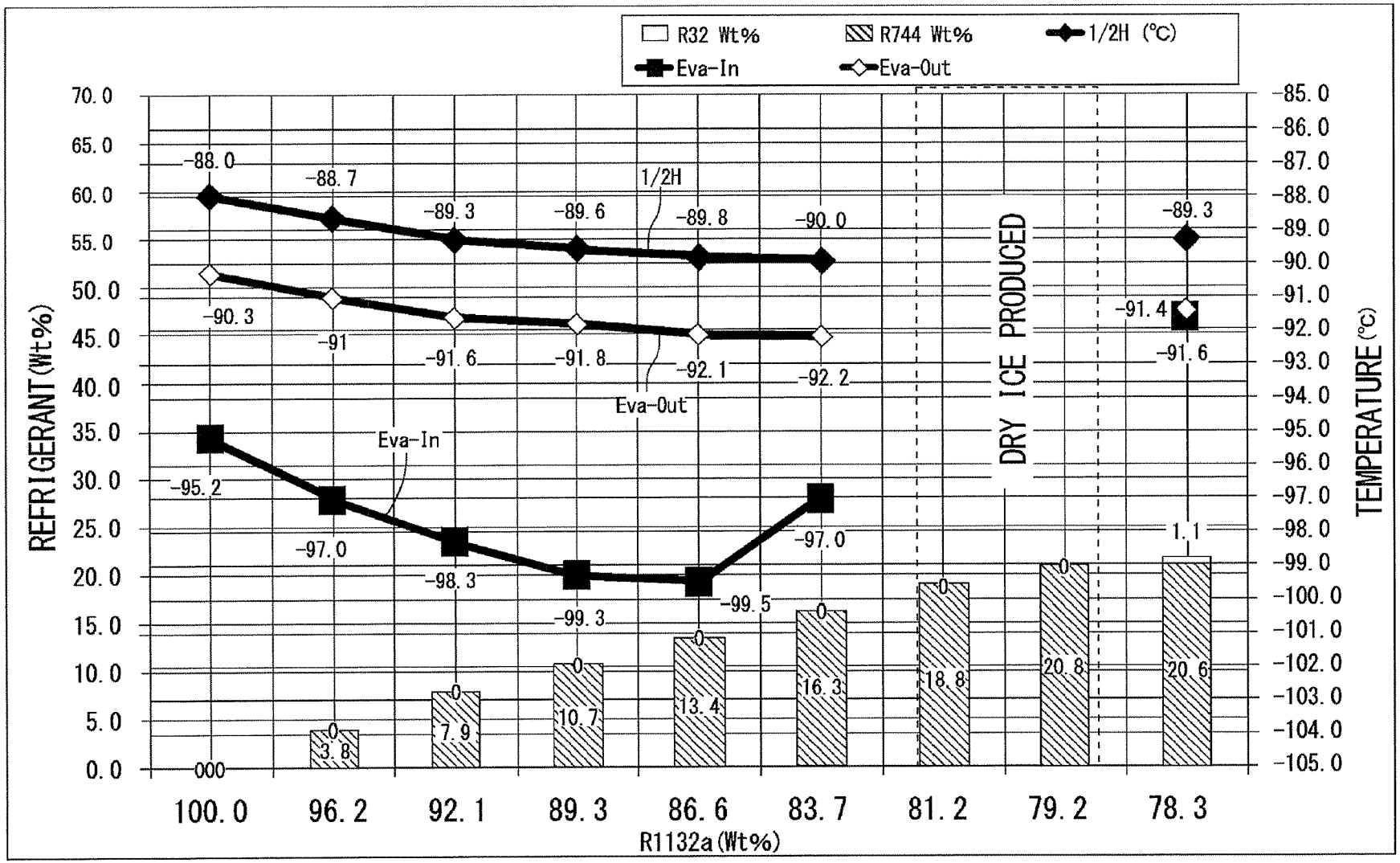
FIG. 7 is a diagram illustrating changes in the inner temperature and the evaporator-inlet temperature in the low-temperature-side refrigerant circuit of FIG. 1 with respect to each refrigerant composition in a refrigerant composite material containing difluoroethylene (R1132a), carbon dioxide (R744), and difluoromethane (R32)

As in the cases of FIGS. 4 and 6 described above, FIG. 7 illustrates changes in the inner temperature (temperature at the middle in the height-wise direction) ½H and in the temperature at the inlet of the evaporator 3 (evaporator-inlet temperature) Eva-In when the proportion (wt %) of carbon dioxide (R744) to the total weight of the refrigerant composite material enclosed in the low-temperature-side refrigerant circuit 6 is varied. Although this is another experimental result obtained with the external temperature and/or the condition of the capillary tube varied, the result shows a similar tendency.

When difluoroethylene (R1132a) was at 100 (wt %); the evaporator-inlet temperature Eva-In was −95.2° C., the outlet temperature of the evaporator 3 (evaporator-outlet temperature) Eva-Out was −90.3° C., and the inner temperature ½H was −88.0° C. When carbon dioxide (R744) was mixed therewith at 3.8 (wt %); the evaporator-inlet temperature Eva-In dropped to −97.0° C., the evaporator-outlet temperature Eva-Out dropped to −91° C., and the inner temperature ½H dropped to −88.7° C. When the proportion of carbon dioxide (R744) to be mixed was increased to 7.9 (wt %); the evaporator-inlet temperature Eva-In dropped to −98.3° C., the evaporator-outlet temperature Eva-Out dropped to −91.6° C., and the inner temperature ½H dropped to −89.3° C.

Furthermore, when the proportion of carbon dioxide (R744) to be mixed was increased to 10.7 (wt %); the evaporator-inlet temperature Eva-In dropped to −99.3° C., the evaporator-outlet temperature Eva-Out dropped to −91.8° C., and the inner temperature ½H dropped to −89.6° C. When the proportion of carbon dioxide (R744) to be mixed was increased to 13.4 (wt %); the evaporator-inlet temperature Eva-In dropped to −99.5° C., the evaporator-outlet temperature Eva-Out dropped to −92.1° C., and the inner temperature ½H dropped to −89.8° C.

Furthermore, when the proportion of carbon dioxide (R744) to be mixed was increased to 16.3 (wt %), although the evaporator-outlet temperature Eva-Out dropped to −92.2° C. and the inner temperature ½H dropped to −90.0° C., the evaporator-inlet temperature Eva-In rose to −97.0° C. Since the evaporator-inlet temperature Eva-In started to rise, it is understood that dry ice has started to be produced at the portions X1 and X2 at which pressure loss is likely to occur in the respective connection pipes 36.

When the proportion of carbon dioxide (R744) to be mixed was increased to 18.8 (wt %) or up to 20.8 (wt %), the evaporator-inlet temperature Eva-In and the inner temperature ½H became extremely unstable and became unmeasurable. This indicates that carbon dioxide (R744) has turned into dry ice, which then has clogged the portions X1 and X2, preventing the refrigerant from flowing therethrough or considerably obstructing the flow. In this state, the inner temperature rises suddenly.

(4-1) Addition of Difluoromethane (R32)

Subsequently, when difluoromethane (R32) was mixed at 1.1 (wt %) with the above composition, or the composition of 79.2 (wt %) difluoroethylene (R1132a) and 20.8 (wt %) carbon dioxide (R744), each temperature stabilized; thus, the evaporator-inlet temperature Eva-In became −91.6° C., the evaporator-outlet temperature Eva-Out became −91.4° C., and the inner temperature ½H became −89.3° C. This indicates that difluoromethane (R32) that is highly soluble in carbon dioxide (R744) has melted and removed the dry ice that has clogged the connection pipes 36 at the portions X1 and X2. The composition at this time was 78.3 (wt %) difluoroethylene (R1132a), 20.6 (wt %) carbon dioxide (R744), and 1.1 (wt %) difluoromethane (R32). The reason why the proportions of difluoroethylene (R1132a) and of carbon dioxide (R744) to the total weight were reduced was that difluoromethane (R32) was added.

In this manner, even when difluoroethylene (R1132a), in place of ethane (R170), is used as the first refrigerant, as difluoromethane (R32) is added, carbon dioxide (R744) can very effectively be prevented from turning into dry ice.

Although ethane (R170) and difluoroethylene (R1132a) are described as non-limiting examples of the first refrigerant having a boiling point of not less than −89.0° C. and not more than −78.1° C. in the examples described above, a mixed refrigerant of difluoroethylene (R1132a) and hexafluoroethane (R116) or a mixed refrigerant of difluoroethylene (R1132a) and ethane (R170) is also effective.

In addition, the present embodiments are also effective when a mixed refrigerant of ethane (R170) and hexafluoroethane (R116), an azeotropic mixture (R508A, boiling point −85.7° C.) of 39 mass % trifluoromethane (R23) and 61 mass % hexafluoroethane (R116), or an azeotropic mixture (R508B, boiling point −86.9° C.) of 46 mass % trifluoromethane (R23) and 54 mass % hexafluoroethane (R116) is used as the first refrigerant.

In addition, although difluoromethane (R32) and 1,1,1,2-tetrafluoroethane (R134a) are described as non-limiting examples of the refrigerant (second refrigerant) that is highly soluble in carbon dioxide (R744) in the examples described above, n-pentane (R600), isobutane (R600a), 1,1,1,2,3-pentafluoropentene (HFO-1234ze), and 1,1,1,2-tetrafluoropentene (HFO-1234yf) are also highly soluble in carbon dioxide (R744) at a temperature lower than the boiling point of carbon dioxide (R744) and can thus be employed as the second refrigerant. The boiling points and the GWPs of these refrigerants are indicated in FIG. 3.

Example 4

Figure 8:
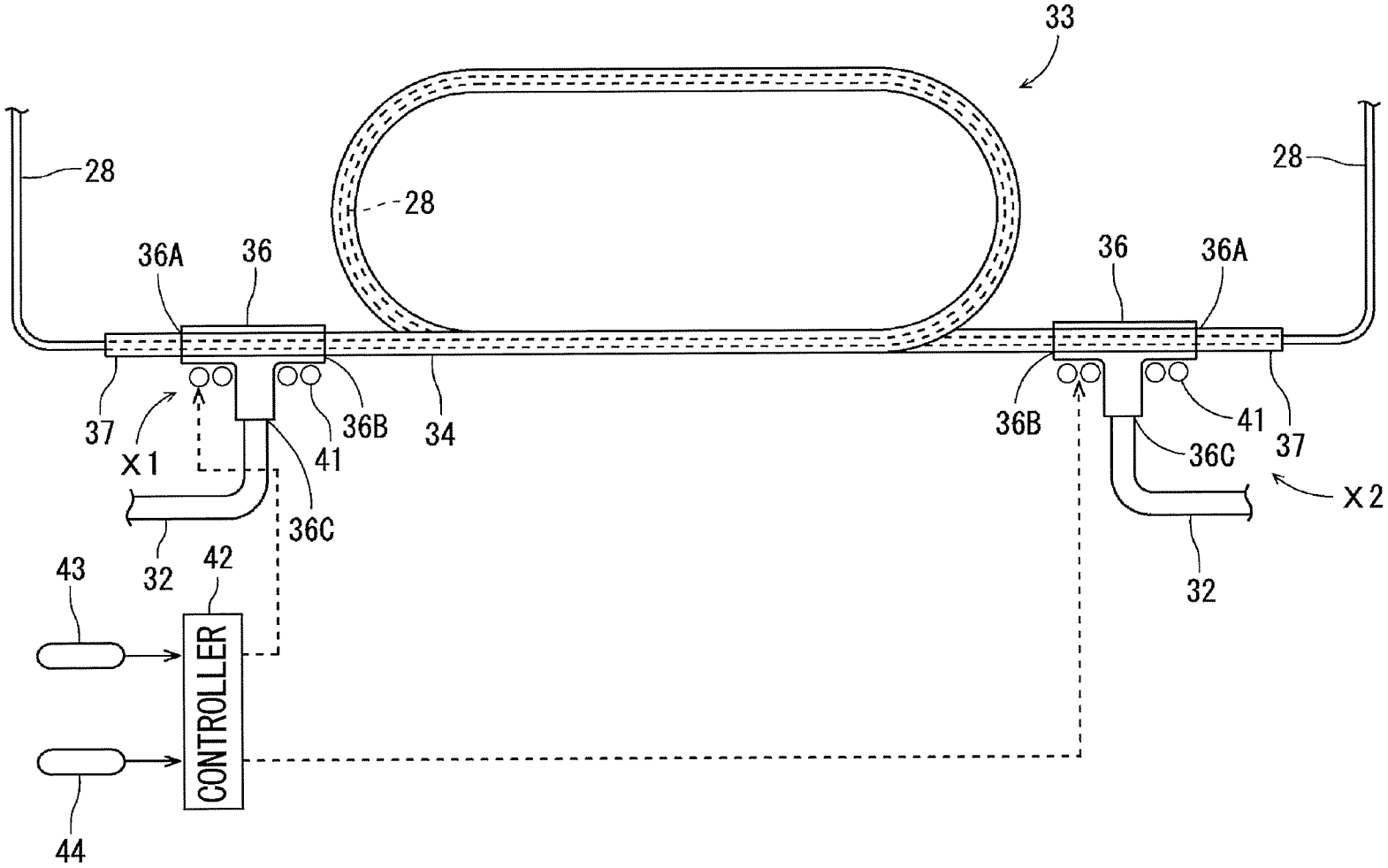
FIG. 8 is an external view of a double-pipe structure portion of another example of the refrigeration apparatus of FIG. 1.

Subsequently, with reference to FIG. 8, another example of the double-pipe structure 33 in the low-temperature-side refrigerant circuit 6 will be described. In this drawing, parts indicated by symbols identical to those in FIG. 2 indicate identical parts. In the example in this case, electric heaters 41 are attached to the double-pipe structure 33 in which carbon dioxide (R744) could turn into dry ice. These electric heaters 41 are wound so as to correspond to the portions X1 and X2 of the respective connection pipes 36 at which the above-described pressure loss is likely to occur.

In the figure, 42 designates a controller serving as a controlling unit that controls the driving of the ultralow-temperature storage DF, and the electric heaters 41 are connected to an output of the controller 42. In addition, an output of an inner-temperature sensor 43, which detects the inner temperature of the storage room CB (region to be cooled through the refrigerating effect of the evaporator 3), and an output of a double-pipe-structure-temperature sensor 44, which detects the temperature of the double-pipe structure 33, are connected to an input of the controller 42.

Then, for example, when the temperature of the double-pipe structure 33 detected by the double-pipe-structure-temperature sensor 44 reaches or falls below a predetermined value, the controller 42 passes electricity to the electric heaters 41 to heat the portions X1 and X2 of the double-pipe structure 33 and stops the passage of electricity to the electric heaters 41 when the temperature rises to an upper limit value having a predetermined differential from the predetermined value. This predetermined value is set to a temperature at which carbon dioxide (R744) turns into dry ice at the portions X1 and X2 of the respective connection pipes 36.

In this manner, when the temperature of the double-pipe structure 33 falls to the predetermined value at which dry ice is produced, the controller 42 causes the electric heaters 41 to heat the portions X1 and X2 of the respective connection pipes 36; thus, carbon dioxide (R744) can be prevented from turning into dry ice at the portions X1 and X2, or produced dry ice can be melted. Thus, along with the effect of difluoromethane (R32) described above, the inconvenience associated with carbon dioxide (R744) turning into dry ice can very effectively be resolved.

Conversely, this example offers an effect that carbon dioxide (R744) can be prevented from turning into dry ice even if the refrigerant that is highly soluble in carbon dioxide (R744), such as difluoromethane (R32) described above, is not added.

As in the example described above, when not only the temperature of the double-pipe structure 33 but also the inner temperature of the storage room CB detected by the inner-temperature sensor 43 rises (predetermined value) relative to a set value, the electricity may be passed to the electric heaters 41 (thereafter, when the inner temperature falls to the set value or when the temperature of the double-pipe structure 33 rises to the upper limit value, the passage of electricity is stopped). Thus, carbon dioxide (R744) turning into dry ice can be recognized more accurately, and the passage of electricity to the electric heaters 41 can be controlled more accurately.

In addition, although the connection pipes 36 are constituted by T-pipes in each of the examples, without being limited thereto, the present embodiments are also effective even in a case of a connection pipe having another shape that is prone to pressure loss, such as a Y-shape or an L-shape. Furthermore, although the present embodiments are applied to the low-temperature-side refrigerant circuit of a so-called binary refrigeration apparatus in the examples, without being limited thereto, the present embodiments can also be applied to a single-stage refrigeration apparatus. In addition, the numerical values indicated in each of the above examples are illustrative in the case of the ultralow-temperature storage DF that was experimentally measured, and may be set as appropriate in accordance with the capacity or the like.

What is claimed is:

1. A refrigeration apparatus, comprising:

a refrigerant circuit that condenses a mixed refrigerant discharged from a compressor, decompresses the refrigerant with a capillary tube, and causes the mixed refrigerant to evaporate in an evaporator to exhibit a refrigeration effect, wherein the mixed refrigerant containing a first refrigerant having a boiling point in an ultralow temperature range of not less than −89.0° C. and not more than −78.1 C and carbon dioxide (R744) is enclosed, the refrigeration effect of not more than −80° C. is exhibited by causing the first refrigerant to evaporate in the evaporator, a heater that heats at least a portion of a suction pipe through which the mixed refrigerant that returns from the evaporator to the compressor passes to thus retain the carbon dioxide (R744) in a liquid phase or in a gas phase or to thus melt the carbon dioxide (R744) in a solidified phase in the suction pipe is provided, the suction pipe includes a double-pipe structure including a main pipe and connection pipes connected to respective ends of the main pipe, wherein the mixed refrigerant that returns from the evaporator to the compressor passes through the main pipe and the connection pipes, and the capillary tube is disposed in the main pipe and is pulled out through the connection pipes at the respective ends, and the heater is directly attached to one of the connection pipes of the double-pipe structure.

2. The refrigeration apparatus according to claim 1, wherein the mixed refrigerant further contains a second refrigerant that is soluble in the carbon dioxide (R744) at a temperature lower than a boiling point of the carbon dioxide (R744).

3. The refrigeration apparatus according to claim 1, further comprising:

a controller that controls passage of electricity to the heater, wherein the controller passes the electricity to the heater in a case in which a temperature of the double-pipe structure reaches or falls below a predetermined value.

4. The refrigeration apparatus according to claim 3, wherein the controller passes the electricity to the heater in a case in which the temperature of the double-pipe structure reaches or falls below the predetermined value and a temperature of a target to be cooled through the refrigeration effect rises with respect to a set value.

5. The refrigeration apparatus according to claim 1, further comprising:

a high-temperature-side refrigerant circuit and a low-temperature-side refrigerant circuit, an evaporator in the high-temperature-side refrigerant circuit and a condenser in the low-temperature-side refrigerant circuit constituting a cascade heat exchanger, wherein the double-pipe structure is provided in the low-temperature-side refrigerant circuit, and in the low-temperature-side refrigerant circuit, the mixed refrigerant is enclosed, or the heater is provided in addition to the mixed refrigerant enclosed therein.

6. The refrigeration apparatus according to claim 1, wherein each of the connection pipes has a shape that is prone to pressure loss.

7. The refrigeration apparatus according to claim 6, wherein each of the connection pipes is a T-pipe.

8. The refrigeration apparatus according to claim 1, further comprising another heater attached to another one of the connection pipes of the double-pipe structure.

9. A refrigeration apparatus, comprising:

a refrigerant circuit that condenses a mixed refrigerant discharged from a compressor, decompresses the mixed refrigerant with a capillary tube, and causes the mixed refrigerant to evaporate in an evaporator to exhibit a refrigeration effect, wherein a double-pipe structure is provided by constituting at least a portion of a suction pipe through which the mixed refrigerant that returns from the evaporator to the compressor passes by a main pipe and connection pipes connected to respective ends of the main pipe, by disposing the capillary tube in the main pipe, and by pulling out the capillary tube through the connection pipes at the respective ends, the mixed refrigerant containing a first refrigerant having a boiling point in an ultralow temperature range of not less than −89.0° C. and not more than −78.1 C, carbon dioxide (R744), and a second refrigerant that is soluble in the carbon dioxide (R744) at a temperature lower than a boiling point of the carbon dioxide (R744) is enclosed, and a heater is directly attached to one of the connection pipes of the double-pipe structure.

10. The refrigeration apparatus according to claim 9, further comprising:

a controller that controls passage of electricity to the heater, wherein the controller passes the electricity to the heater in a case in which a temperature of the double-pipe structure reaches or falls below a predetermined value.

11. The refrigeration apparatus according to claim 10, wherein the controller passes the electricity to the heater in a case in which the temperature of the double-pipe structure reaches or falls below the predetermined value and a temperature of a target to be cooled through the refrigeration effect rises with respect to a set value.

12. The refrigeration apparatus according to claim 9, further comprising:

a high-temperature-side refrigerant circuit and a low-temperature-side refrigerant circuit, an evaporator in the high-temperature-side refrigerant circuit and a condenser in the low-temperature-side refrigerant circuit constituting a cascade heat exchanger, wherein the double-pipe structure is provided in the low-temperature-side refrigerant circuit, and in the low-temperature-side refrigerant circuit, the mixed refrigerant is enclosed, or the heater is provided in addition to the mixed refrigerant enclosed therein.

13. The refrigeration apparatus according to claim 9, wherein each of the connection pipes has a shape that is prone to pressure loss.

14. The refrigeration apparatus according to claim 13, wherein each of the connection pipes is a T-pipe.

15. The refrigeration apparatus according to claim 9, further comprising another heater attached to another one of the connection pipes of the double-pipe structure.

* * * * *